US012419374B2

(12) United States Patent
Gao

(10) Patent No.: US 12,419,374 B2
(45) Date of Patent: Sep. 23, 2025

(54) BELT WITH TAIL CLIP

(71) Applicant: Guangdong Hongrun Precision Metal Technology Co., Ltd., Zhaoqing (CN)

(72) Inventor: Maoyang Gao, Guangdong (CN)

(73) Assignee: Guangdong Hongrun Precision Metal Technology Co., Ltd., Zhaoqing (CN)

( * ) Notice: Subject to any disclaimer, the term of this patent is extended or adjusted under 35 U.S.C. 154(b) by 28 days.

(21) Appl. No.: 18/420,784

(22) Filed: Jan. 24, 2024

(65) Prior Publication Data

US 2025/0031790 A1 Jan. 30, 2025

(30) Foreign Application Priority Data

Jul. 25, 2023 (CN) ..... 202321972158.6
Aug. 31, 2023 (CN) ..... 202322369637.5

(51) Int. Cl.

| | |
|---|---|
| ***A41F 9/02*** | (2006.01) |
| ***A41F 9/00*** | (2006.01) |
| ***A44B 11/04*** | (2006.01) |
| ***A44B 11/12*** | (2006.01) |
| ***A44B 11/25*** | (2006.01) |

(52) U.S. Cl.
CPC ..... *A41F 9/002* (2013.01); *A44B 11/04* (2013.01); *A44B 11/2511* (2013.01)

(58) Field of Classification Search
CPC ..... A44B 11/00; A44B 11/0006; A44B 11/02; A44B 11/25; A44B 11/258; A44B 11/2592; A44B 11/26; A44B 11/06; A44B 11/04; A44B 11/12; A44B 11/2584; A44B 11/2588; A44B 11/263; Y10T 24/4745; Y10T 24/47; Y10T 24/4736; A41F 9/002
See application file for complete search history.

(56) References Cited

U.S. PATENT DOCUMENTS

| | | | | |
|---|---|---|---|---|
| 237,894 | A * | 2/1881 | Owen | A41F 9/002 24/182 |
| 2,686,920 | A * | 8/1954 | Meeker | A44B 11/00 2/322 |
| 5,920,964 | A * | 7/1999 | Malzahn | A41F 9/002 24/442 |
| 6,351,874 | B1 * | 3/2002 | Suggs | A44B 11/006 24/265 R |
| 10,264,855 | B1 * | 4/2019 | Jeanty | A44B 11/16 |
| 2013/0091668 | A1 * | 4/2013 | Turdjian | A44B 11/06 24/579.11 |
| 2020/0289131 | A1 * | 9/2020 | Whelan | A61B 17/1327 |

* cited by examiner

*Primary Examiner* — Jack W Lavinder

(57) ABSTRACT

Disclosed is a belt with a tail clip. The belt with a tail clip includes a belt body provided with a connecting buckle and the tail clip. The connecting buckle includes a male buckle, a female buckle and a clamping device; a male buckle clamping portion and a female buckle clamping portion are clamped and connected through the clamping device; a belt fixing groove and a belt sliding through groove are formed in the tail clip; and one end of the belt body is fixed to the male buckle, and an end portion of the other end of the belt body is fixed into the belt fixing groove after the other end of the belt body passes through the belt sliding through groove and bypasses the inner connecting rod. The belt with a tail clip has advantages of convenience in belt length adjustment and good locking effect.

10 Claims, 13 Drawing Sheets

BELT WITH TAIL CLIP

CROSS REFERENCE TO RELATED APPLICATIONS

The present disclosure claims priorities of Chinese Patent Application No. 202321972158.6 filed on Jul. 25, 2023 and No. 202322369637.5 filed on Aug. 31, 2023, the entire contents of which are hereby incorporated by reference.

TECHNICAL FIELD

The present disclosure relates to the technical field of a belt, and in particular to a belt with a tail clip.

BACKGROUND

With people's pursuit of fashion, a belt not only has a girdling effect, but also has become a highlight of the overall clothing decoration. An existing belt generally consists of a belt body and a belt buckle, and a belt ring is sheathed on some belts. One end of the belt body passes through the belt ring and bypasses a connecting rod on the belt buckle, and then, an end portion of the belt body is limited and fixed by the belt ring, so that the belt body between the belt buckle and the belt ring is an overlapped portion. The belt ring slides on the belt body to change a fixing position of the end portion of the belt ring, a length of the overlapped portion of the belt body is changed, and a use length of the belt is further adjusted. In a use process, a head end of the belt body is fixed to one end of the belt buckle, a tail end of the belt body is connected with the other end of the belt buckle, the position of the tail end of the belt body is limited through the belt ring, and the connection or disconnection between two ends of the belt body is realized through the own connecting structure of the two ends of the belt buckle. By using a fixing manner of limiting the end portion of the belt body by the belt ring, in the use process, the tail end of the belt body may be easily disengaged from the belt ring. After the limitation of the tail end of the belt body is relieved, the belt body may easily slip around the belt buckle, so that the use length of the belt is increased, and the girdling effect cannot be achieved. If the tail end of the belt body completely passes through the belt ring, a portion of the tail end of the belt body passing through the belt ring may be easily in an upwarping state, and the fashionability of the whole belt is influenced.

Therefore, the present disclosure provides a belt with a tail clip.

SUMMARY

The present disclosure has the purpose of providing a belt with a tail clip, a length of the belt is convenient to adjust, the adjusting range is wide, the appearance is fashionable, and the locking effect is good.

In order to realize the above purpose, the present disclosure adopts the following technical solution:

a belt with a tail clip includes: a belt body provided with a connecting buckle and the tail clip; two ends of the belt body are respectively a first connecting portion and a second connecting portion; the connecting buckle includes a male buckle, a female buckle and a clamping device, one end of the male buckle is provided with a first connecting component, the other end of the male buckle is provided with a male buckle clamping portion, one end of the female buckle is provided with a second connecting component, the other end of the female buckle is provided with a female buckle clamping portion, the second connecting component includes an outer connecting rod and an inner connecting rod, and the male buckle clamping portion and the female buckle clamping portion are clamped and connected through the clamping device; a belt fixing groove and a belt sliding through groove are formed in the tail clip; and the first connecting portion of the belt body is fixed to the first connecting component of the male buckle, and an end portion of the second connecting portion of the belt body is fixed into the belt fixing groove after the second connecting portion of the belt body passes through the belt sliding through groove and bypasses the inner connecting rod.

Further, the male buckle clamping portion is provided with a clamping groove, the female buckle clamping portion is provided with a clamping fixing groove, the clamping device comprises a rotating plate clamped in the clamping fixing groove and a safety device disposed on the rotating plate, a rotating shaft is disposed in a middle of the rotating plate, the rotating plate is rotationally connected with the female buckle clamping portion through the rotating shaft, one end of the rotating plate is provided with a reset spring, and the other end of the rotating plate is provided with a clamp hook corresponding to the clamping groove.

Further, a sliding groove matched with the male buckle clamping portion is formed in the female buckle clamping portion, and a limiting surface matched with the male buckle clamping portion is disposed on the sliding groove.

Further, the safety device comprises a pressing sliding plate glidingly disposed at an outer side of the rotating plate, the pressing sliding plate is disposed at one end of the rotating plate near the reset spring, and a positioning device is disposed between the rotating plate and the pressing sliding plate.

Further, a bead fixing tube is disposed on a rotating plate in a protruded manner, a positioning device comprises an elastic bead disposed in the bead fixing tube, and a first positioning groove and a second positioning groove matched with the elastic bead are respectively formed in an inner side of a pressing sliding plate; and a spring fixing groove corresponding to the bead fixing tube is formed in a clamping fixing groove, one end of a reset spring is sheathed outside the bead fixing tube, and the other end of the reset spring is matched with the spring fixing groove.

Further, two corresponding positioning sliding grooves are formed on a rotating plate, L-shaped slide blocks corresponding to the positioning sliding grooves are disposed on a pressing sliding plate, and corresponding guide convex strips are respectively disposed at two sides of the pressing sliding plate on the rotating plate.

Further, an inner side of the tail clip is in an arch shape.

Further, anti-slip teeth are disposed at one side of the belt sliding through groove.

Further, a suture groove is formed in an outer side of the belt fixing groove on the tail clip.

Further, one end of the male buckle is provided with a connecting groove, the first connecting component comprises a tail tooth plate rotationally disposed in the connecting groove, a plurality of teeth are disposed on the tail tooth plate, and each of the teeth is in an inclined conical shape.

The belt provided by the present disclosure includes a belt body provided with a connecting buckle and the tail clip; two ends of the belt body are respectively a first connecting portion and a second connecting portion; the connecting buckle includes a male buckle, a female buckle and a clamping device, one end of the male buckle is provided with a first connecting component, the other end of the male buckle is provided with a male buckle clamping portion, one end of the female buckle is provided with a second connecting component, the other end of the female buckle is provided with a female buckle clamping portion, the second connecting component includes an outer connecting rod and an inner connecting rod, and the male buckle clamping portion and the female buckle clamping portion are clamped and connected through the clamping device; a belt fixing groove and a belt sliding through groove are formed in the tail clip; and the first connecting portion of the belt body is fixed to the first connecting component of the male buckle, and an end portion of the second connecting portion of the belt body is fixed into the belt fixing groove after the second connecting portion of the belt body passes through the belt sliding through groove and bypasses the inner connecting rod. The present disclosure has advantages that a length of the belt is convenient to adjust, the adjusting range is wide, the appearance is fashionable, and the locking effect is good.

DETAILED DESCRIPTION

Figure 1:
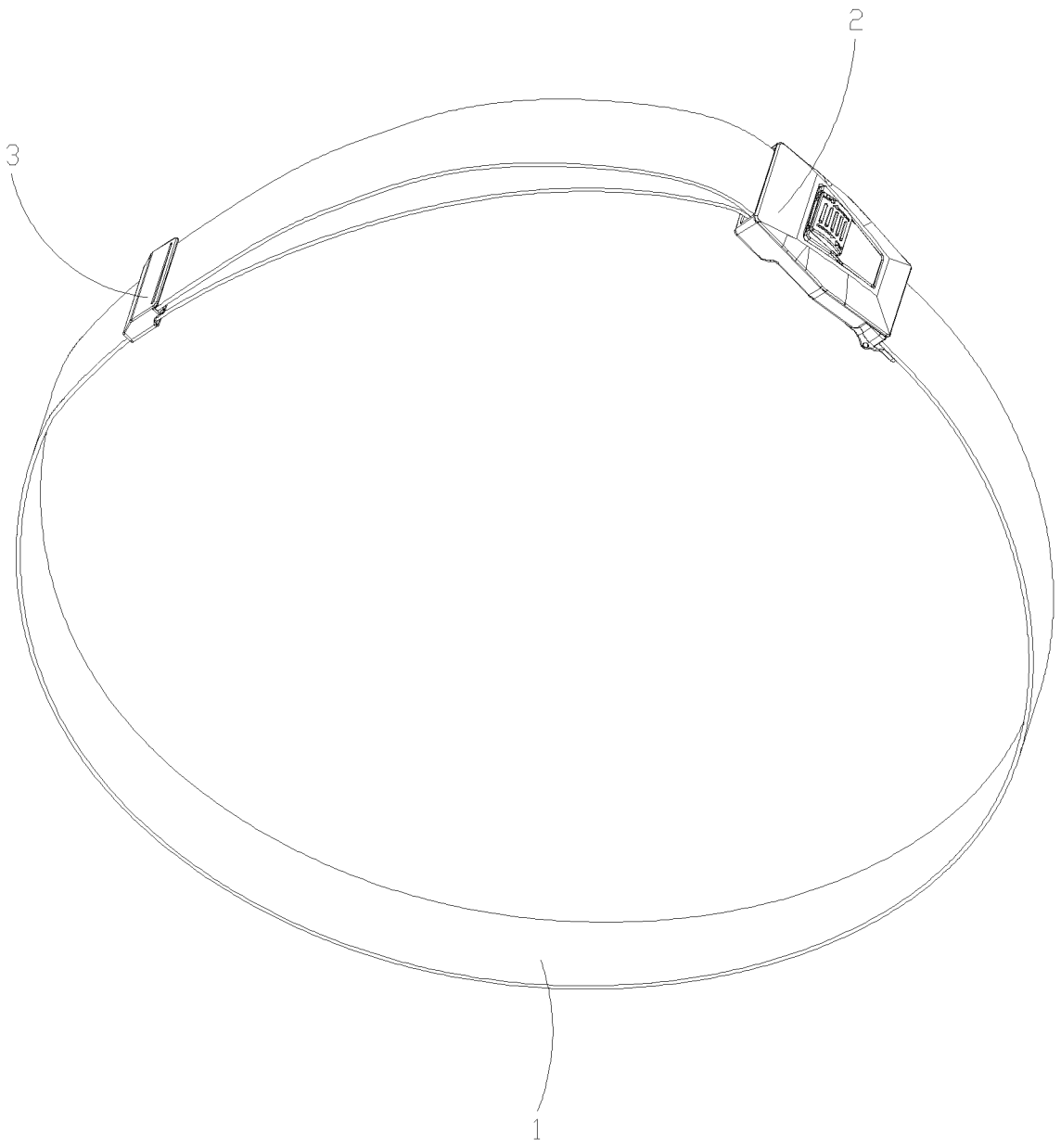
FIG. 1 is a perspective view of a belt according to Embodiment 1 provided by the present disclosure.
Figure 2:
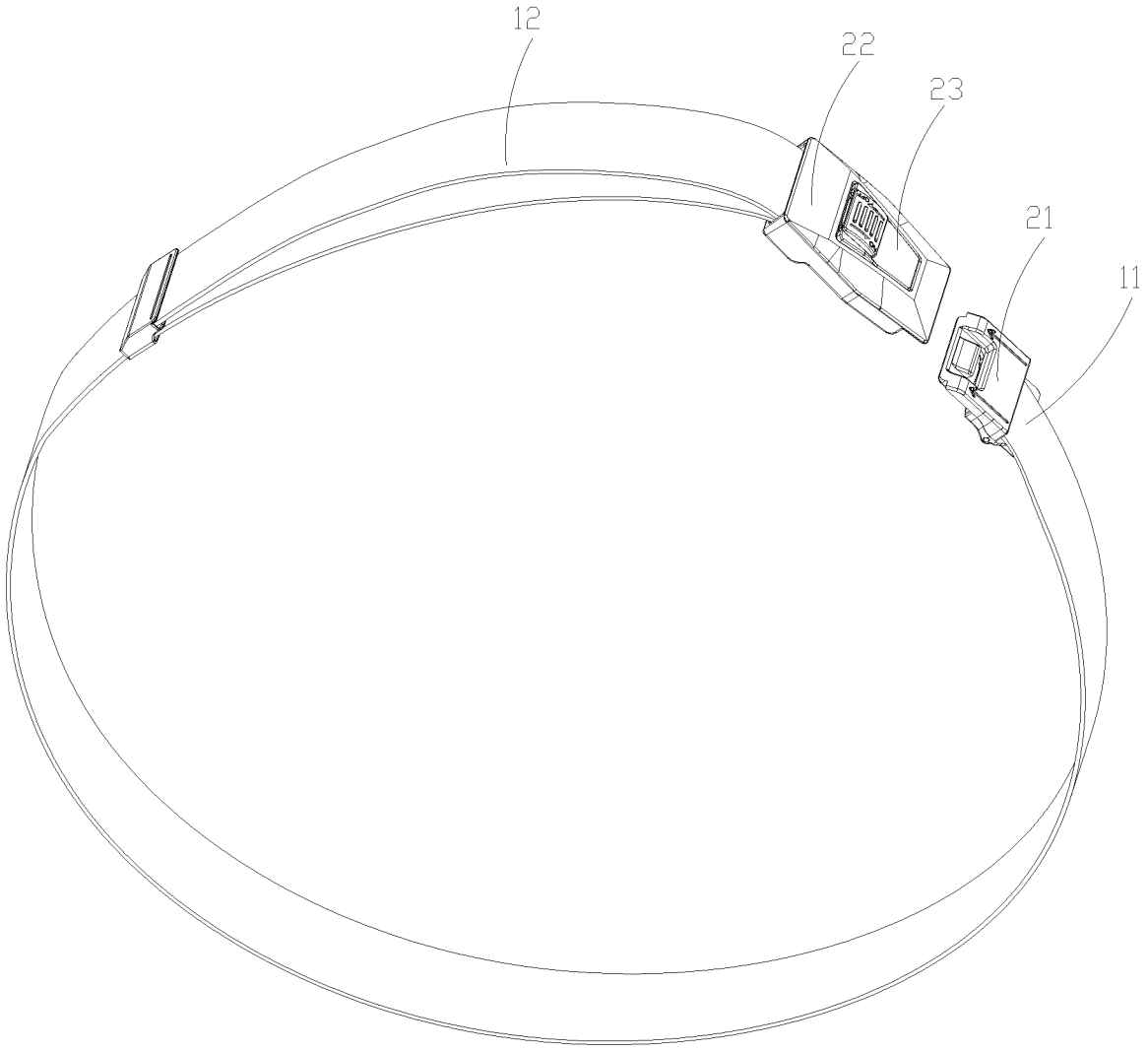
FIG. 2 is a use state diagram of a belt according to Embodiment 1 provided by the present disclosure.
Figure 3:
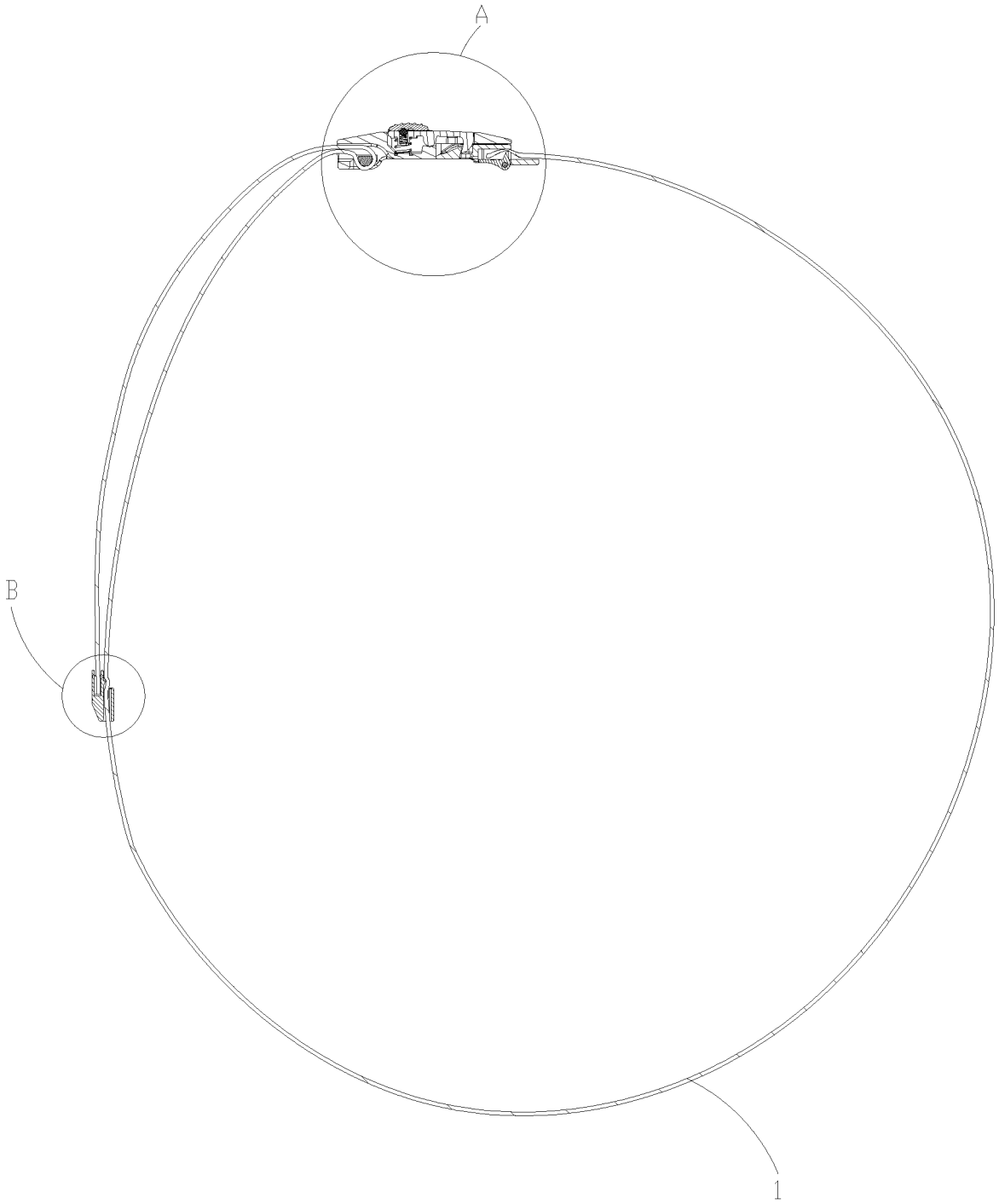
FIG. 3 is a section view of a belt according to Embodiment 1 provided by the present disclosure.
Figure 4:
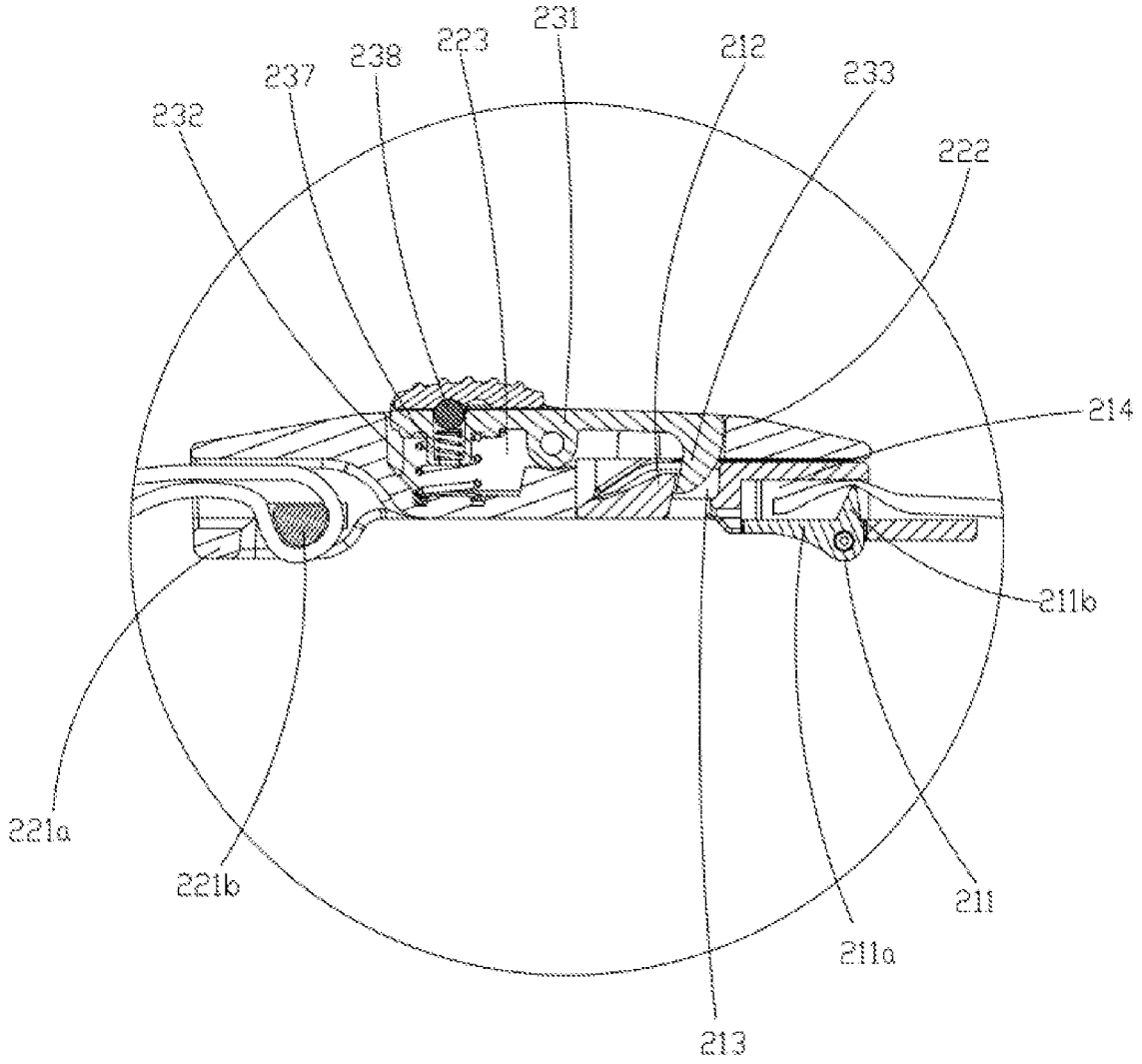
FIG. 4 is a local enlarged view of Portion A in FIG. 3.
Figure 5:
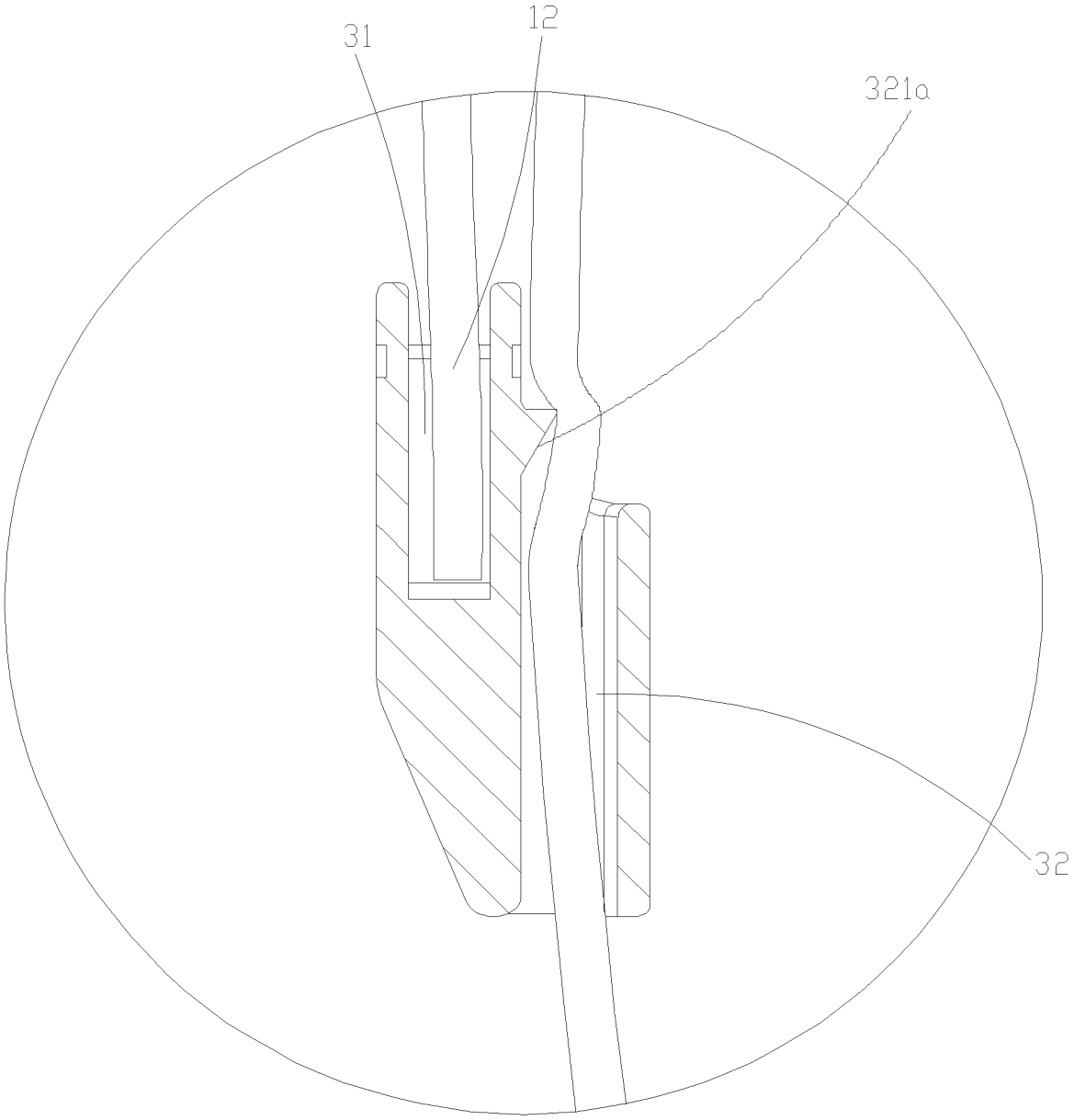
FIG. 5 is a local enlarged view of Portion B in FIG. 3.
Figure 6:
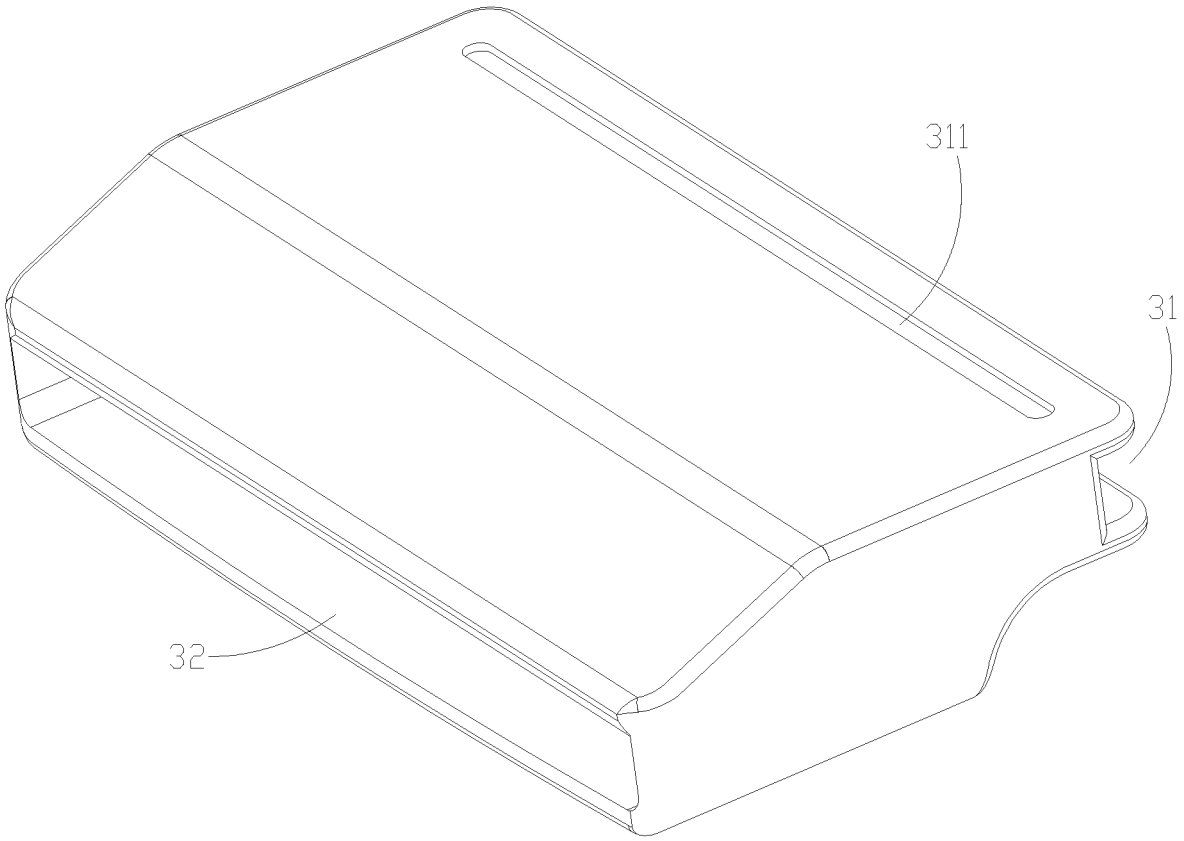
FIG. 6 is a perspective view 1 of a tail clip of a belt according to Embodiment 1 provided by the present disclosure.
Figure 7:
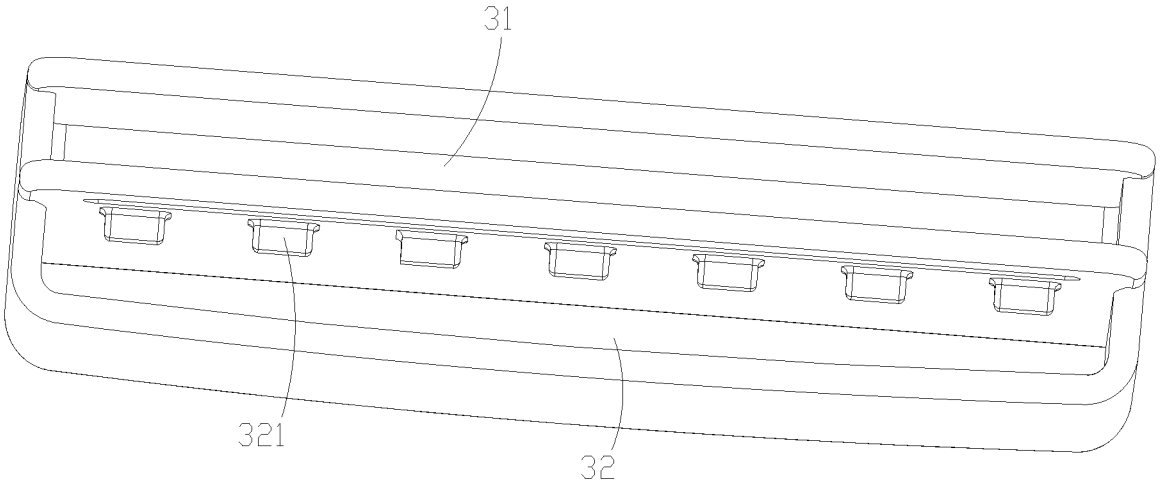
FIG. 7 is a perspective view 2 of a tail clip of a belt according to Embodiment 1 provided by the present disclosure.
Figure 8:
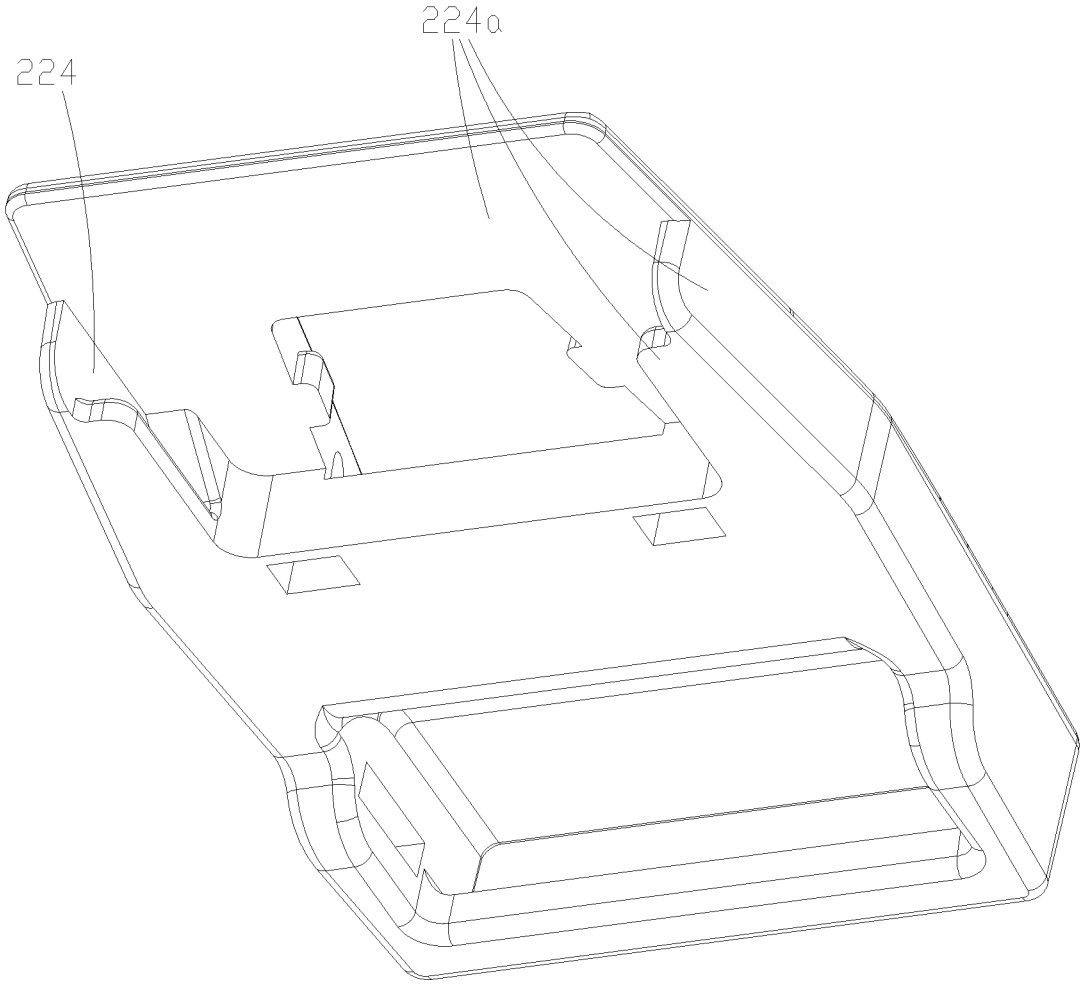
FIG. 8 is a perspective view of a female buckle of a belt according to Embodiment 1 provided by the present disclosure.

The present disclosure provides a belt with a tail clip. In order to make the objective, technical solution and effect of the present disclosure clearer and more specific, the present disclosure is further illustrated in detail hereafter with reference to the accompanying drawings and embodiments. It should be understood that the specific embodiments described herein are provided for describing the present disclosure and not intended to limit the scope of the present disclosure.

The belt with a tail clip provided by the present disclosure has a structure as shown in FIG. 1 to FIG. 16, and includes a belt body 1. A connecting buckle 2 and the tail clip 3 are disposed on the belt body 1.

Two ends of the belt body 1 are respectively a first connecting portion 11 and a second connecting portion 12.

The connecting buckle 2 includes a male buckle 21, a female buckle 22 and a clamping device 23. One end of the male buckle 21 is provided with a first connecting component 211, and the other end of the male buckle is provided with a male buckle clamping portion 212. One end of the female buckle 22 is provided with a second connecting component, and the other end of the female buckle is provided with a female buckle clamping portion 222. The second connecting component includes an outer connecting rod 221*a* and an inner connecting rod 221*b*, and the male buckle clamping portion 212 and the female buckle clamping portion 222 are clamped and connected through the clamping device 23.

A belt fixing groove 31 and a belt sliding through groove 32 are formed in the tail clip 3.

The first connecting portion 11 of the belt body 1 is fixed to the first connecting component 211 of the male buckle 21, and an end portion of the second connecting portion of the belt body is fixed into the belt fixing groove 31 after the second connecting portion 12 of the belt body 1 passes through the belt sliding through groove 32 and bypasses the inner connecting rod 221*b*. Therefore, the first connecting portion 11 of the belt body 1 is fixed to the male buckle 21. The second connecting portion 12 of the belt body 1 is connected with the female buckle 22, and the male buckle 21 can be locked with or separated from the female buckle 22 through the clamping device 23 to realize the buckling or unbuckling of the belt. Through the belt sliding through groove 32, the tail clip 3 slides on the belt body 1, a distance between the tail clip 3 and the female buckle 22 changes, a length of an overlapped portion of the second connecting portion 12 of the belt body 1 changes, and a use length of the belt body 1 respectively connected with the male buckle 21 and the female buckle 22 can be fast adjusted, and the fast adjustment on the length of the belt is realized. The end portions of the first connecting portion 11 and the second connecting portion 12 of the belt body 1 are respectively fixed to the male buckle 21 and the tail clip 3, so that an end portion of the belt body 1 cannot upwarp, and the whole belt has high fashionability. Additionally, the belt with a tail clip has a wide length adjusting range, and a range of applicable users is wide. For belt production and sales enterprises, the length specification of the belt can be reduced, and the stock can be effectively reduced.

Figure 9:
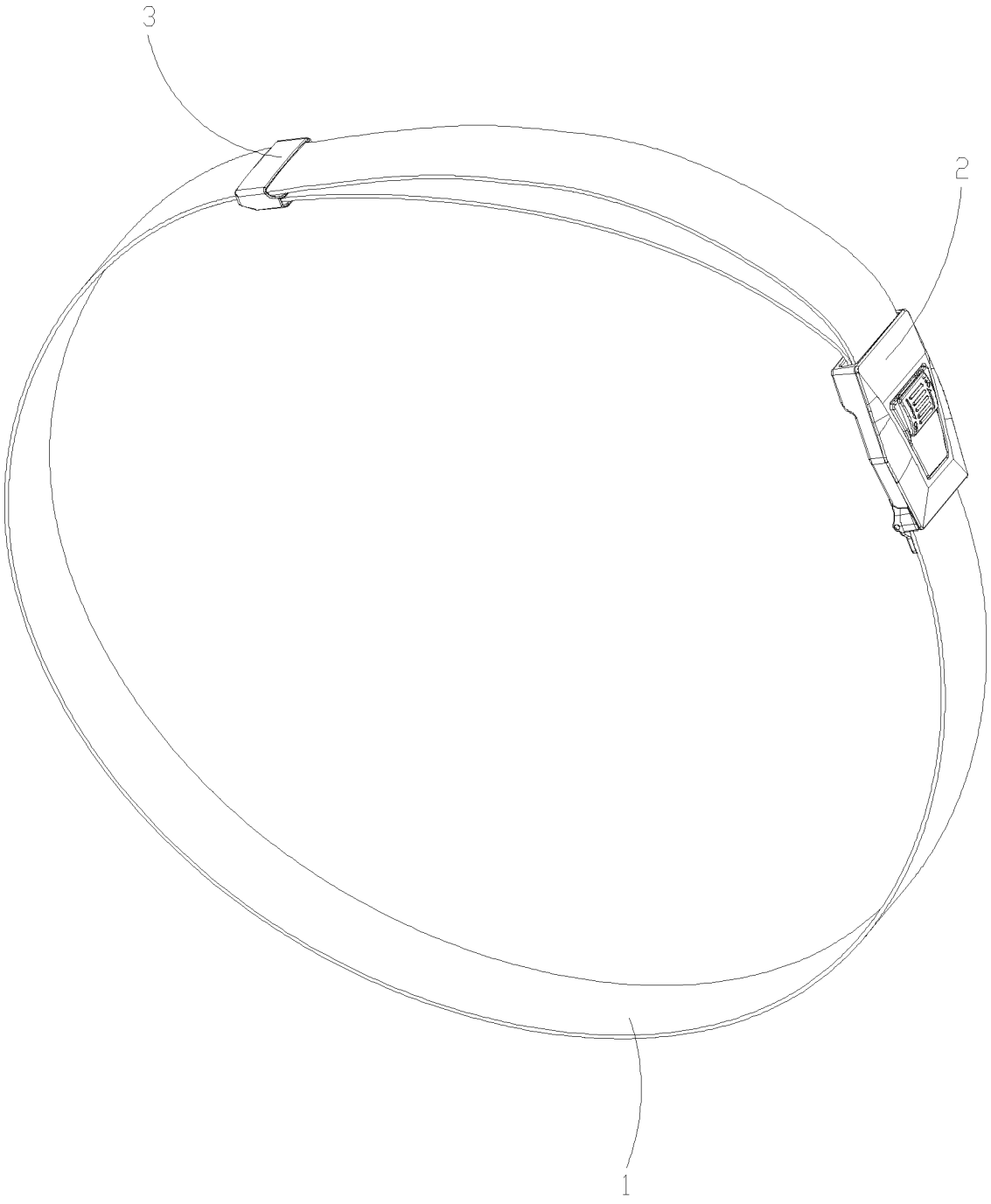
FIG. 9 is a perspective view of a belt according to Embodiment 2 provided by the present disclosure.
Figure 10:
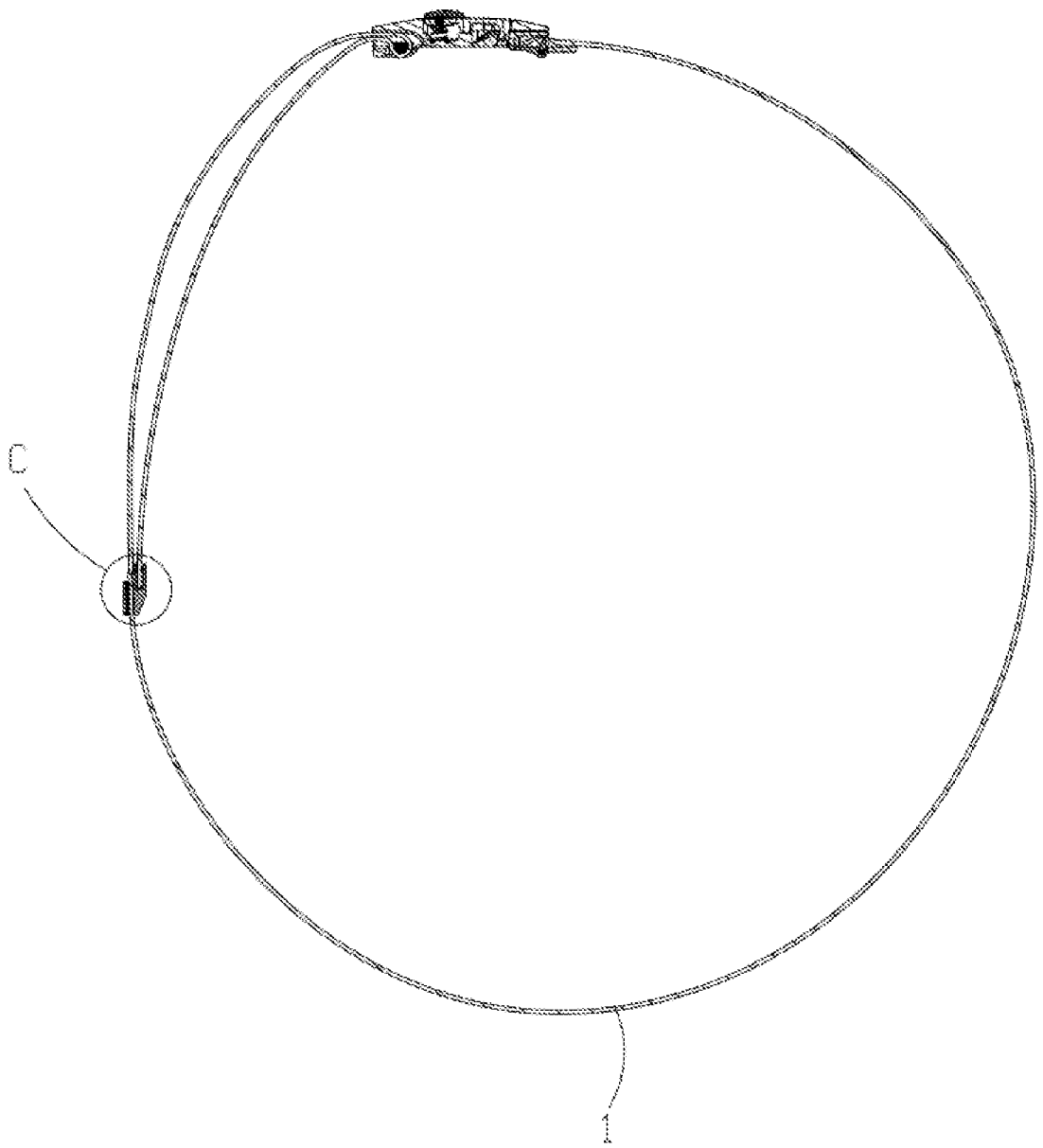
FIG. 10 is a section view of a belt according to Embodiment 2 provided by the present disclosure.
Figure 11:
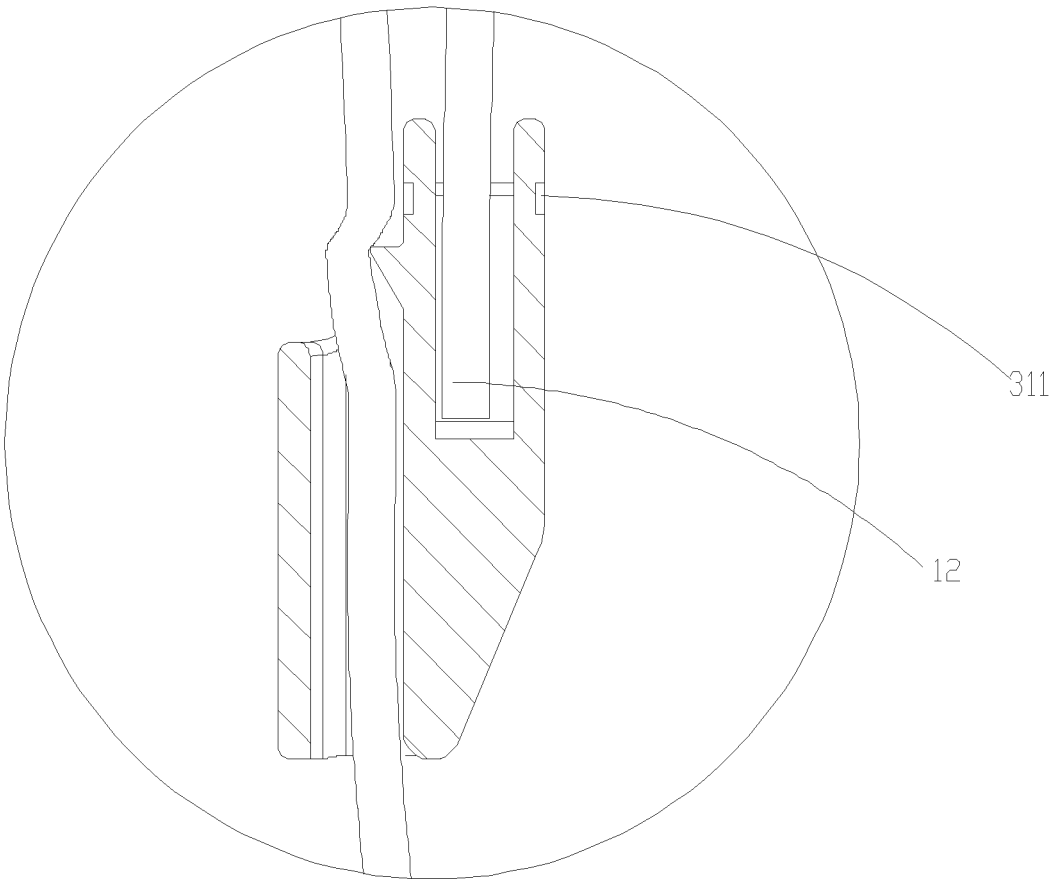
FIG. 11 is a local enlarged view of Portion C in FIG. 10.
Figure 12:
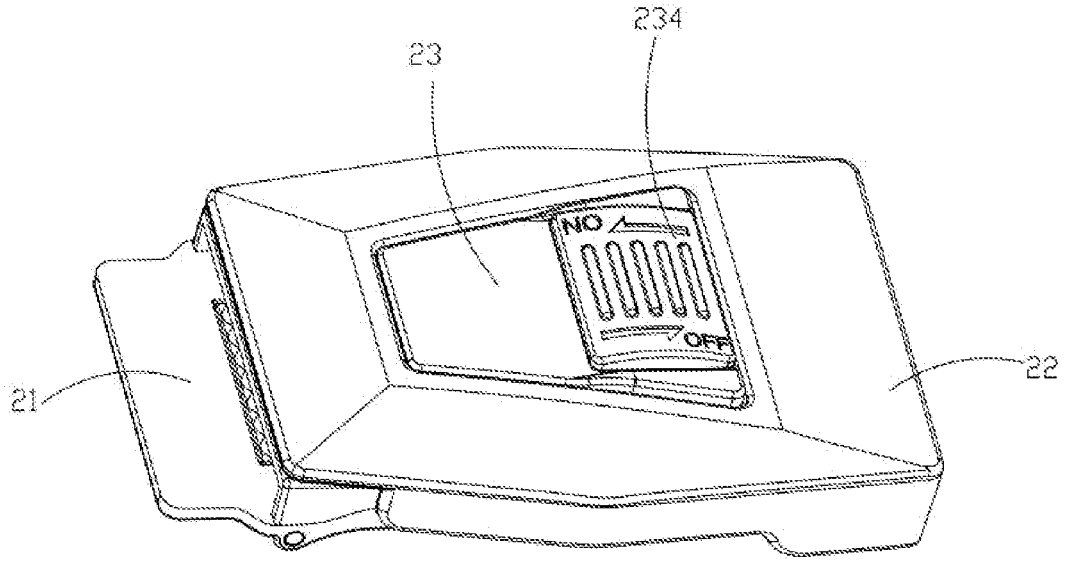
FIG. 12 is a perspective view of a connecting buckle of a belt with a tail clip according to the present disclosure.
Figure 13:
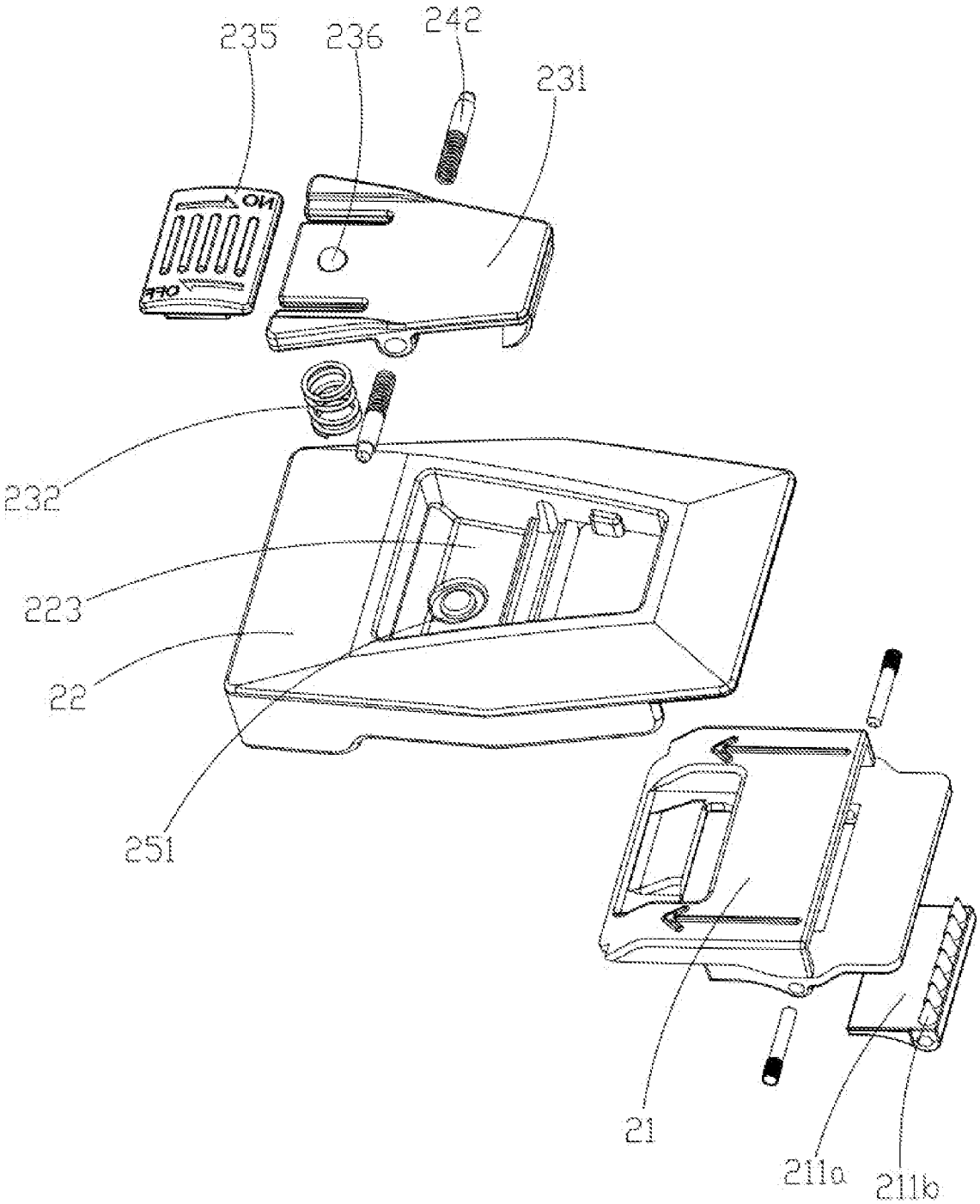
FIG. 13 is an exploded view of a connecting buckle of a belt with a tail clip according to the present disclosure.
Figure 14:
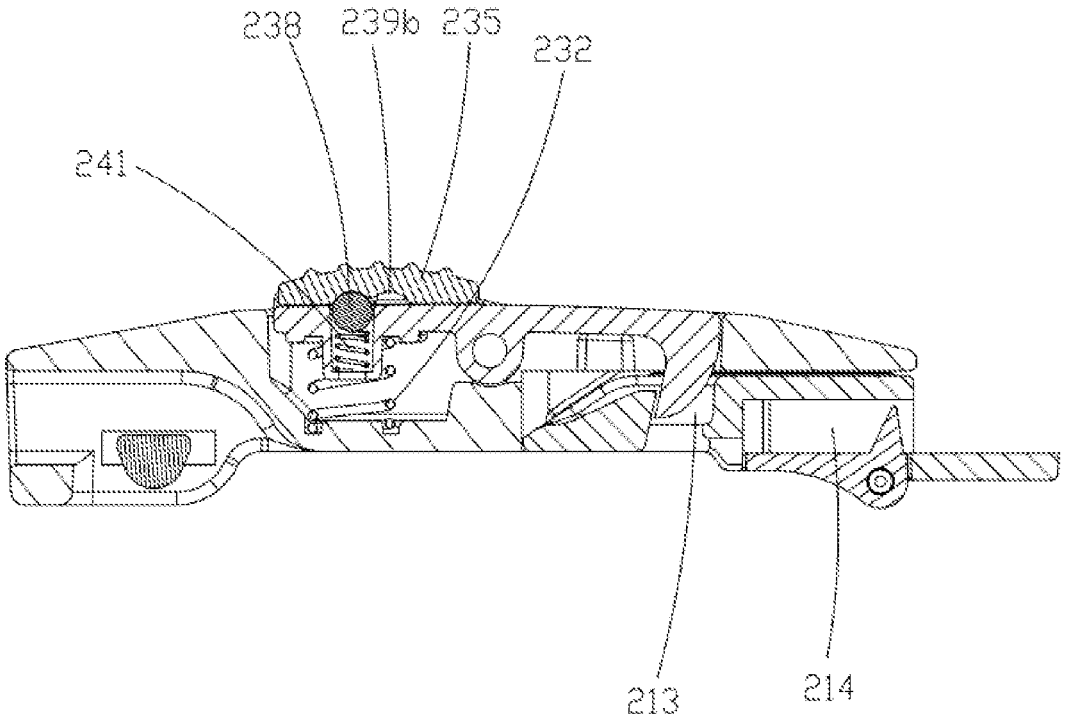
FIG. 14 is a section view of a connecting buckle of a belt with a tail clip according to the present disclosure.
Figure 15:
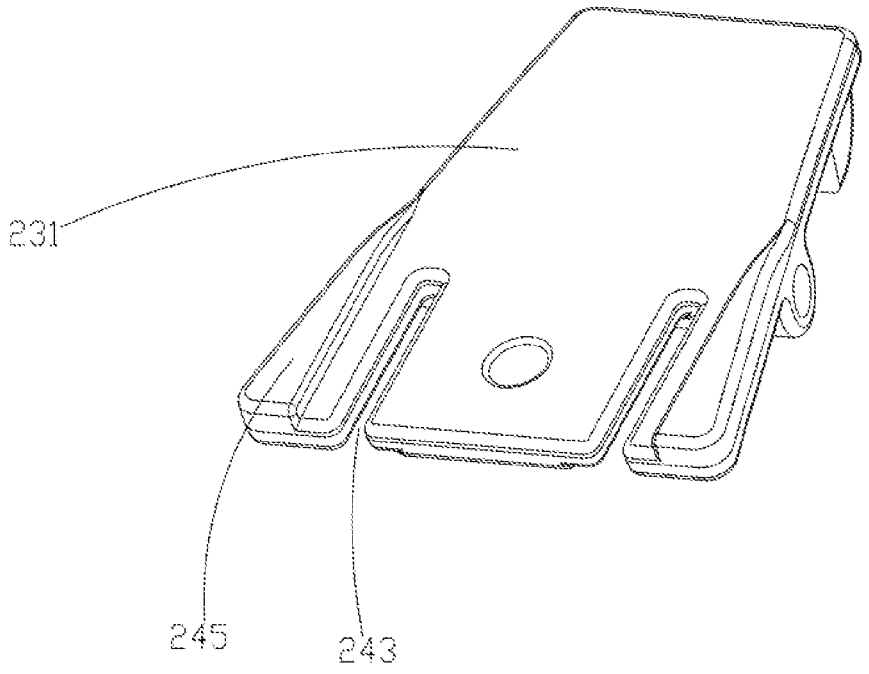
FIG. 15 is a perspective view of a rotating plate of a belt with a tail clip according to the present disclosure.
Figure 16:
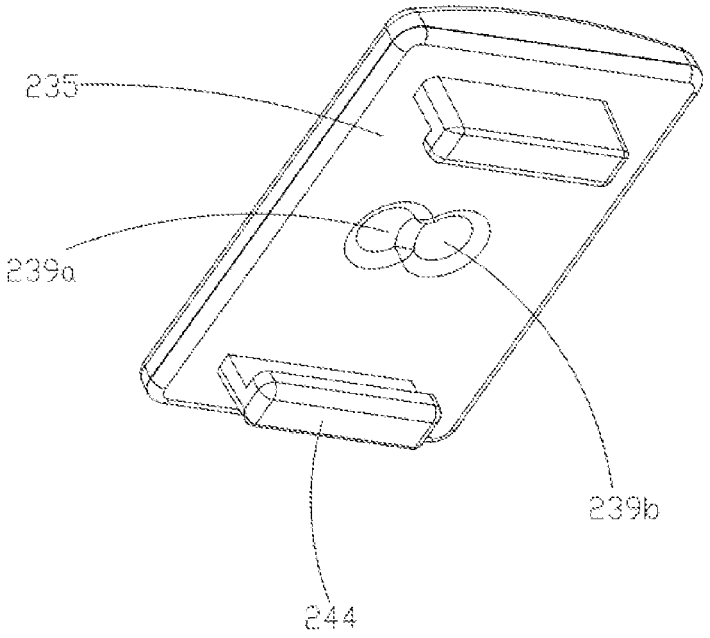
FIG. 16 is a perspective view of a pressing sliding plate of a rotating plate of a belt with a tail clip according to the present disclosure.

In Embodiment 1 as shown in FIG. 1 to FIG. 8, when the belt is used, the belt fixing groove 31 is positioned at an outer side of the belt sliding through groove 32, the overlapped portion of the second connecting portion 12 of the belt body 1 is positioned at an outer side of an inner circle of the belt, and the use experience of a user is good. In Embodiment 2 as shown in FIG. 9 to FIG. 11, when the belt is used, the belt fixing groove 31 is positioned at an inner side of the belt sliding through groove 32, the whole fashionability is high, the tail clip 3 is fixed in different manners, and the diversity of the belt is improved.

In the embodiment provided by the present disclosure, a sliding groove matched with the inner connecting rod 221*b* is formed in the female buckle 22. The outer connecting rod 221*a* and the female buckle 22 are integrally manufactured. The inner connecting rod 221*b* can slide relative to the outer connecting rod 221*a*. Through the slidable inner connecting rod 221*b*, the belt body 1 can conveniently bypass the inner connecting rod 221*b*. Additionally, a gap is formed between the female buckle body and the outer connecting rod 221*a*, and when the belt body 1 is connected with the female buckle 22, the second connecting portion 12 enters the gap, and then extends out of the gap after bypassing the inner connecting rod 221*b*. Under the condition that the length of the belt is adjusted to be proper, the belt body 1 is difficult to relatively slide in the gap, and at the same time, the slippage around the inner connecting rod 221*b* is difficult to occur, so that a good locking effect is achieved.

Specifically, as shown in FIG. 12 to FIG. 16, the male buckle clamping portion 212 is provided with a clamping groove 213. The female buckle clamping portion 222 is provided with a clamping fixing groove 223. The clamping device 23 includes a rotating plate 231 clamped in the clamping fixing groove 223 and a safety device 234 disposed on the rotating plate 231. A rotating shaft 242 is disposed in a middle of the rotating plate 231. The rotating plate 231 is rotationally connected with the female buckle clamping portion 222 through the rotating shaft 242. One end of the rotating plate 231 is provided with a reset spring 232, and the other end of the rotating plate is provided with a clamp hook 233 corresponding to the clamping groove 213. The male buckle 21 and the female buckle 22 are connected through the clamp hook 233.

The safety device 234 includes a pressing sliding plate 235 glidingly disposed on the rotating plate 231, the pressing sliding plate 235 is disposed at one end of the rotating plate 231 near the reset spring 232, a positioning device 236 is disposed between the rotating plate 231 and the pressing sliding plate 235, and the pressing sliding plate 235 is positioned through the positioning device 236.

Specifically, a bead fixing tube 237 is disposed on the rotating plate 231 in a protruded manner. The positioning device 236 includes an elastic bead 238 and a bead spring 241 disposed in the bead fixing tube 237, and the bead spring 241 provides elastic support for the elastic bead 238. The elastic bead 238 protrudes out of an upper surface of the rotating plate 231. A first positioning groove 239*a* and a second positioning groove 239*b* matched with the elastic bead 238 are respectively formed in an inner side of the pressing sliding plate 235. When the first positioning groove 239*a* and the elastic bead 238 are matched, the pressing sliding plate 235 is in a first position. When the second positioning groove 239*b* and the elastic bead 238 are matched, the pressing sliding plate 235 is in a second position. If the pressing sliding plate 235 is in the first position, and the end of the rotating plate 231 provided with the pressing sliding plate 235 is pressed by hand, the rotating plate 231 rotates around the rotating shaft 242, the clamp hook 233 of the rotating plate 231 upwarps, and the clamp hook 233 is unclamped from the clamping groove 213. That is, the male buckle 21 and the female buckle 22 are disconnected, and the belt is unbuckled. If the pressing sliding plate 235 is in the second position, a portion of the pressing sliding plate 235 is abutted against an outer side surface of the female buckle clamping portion 222. At this moment, the rotating plate 231 cannot rotate when being pressed, the clamp hook 233 cannot be unclamped from the clamping groove 213, and the male buckle 21 and the female buckle 22 are more safely and reliably clamped and connected.

Specifically, two corresponding positioning sliding grooves 243 are formed on the rotating plate 231, L-shaped slide blocks 244 corresponding to the positioning sliding grooves 243 are disposed on the pressing sliding plate 235, and corresponding guide convex strips 245 are respectively disposed at two sides of the pressing sliding plate on the rotating plate 231. The L-shaped slide blocks 244 are clamped and connected in the sliding grooves 243, the pressing sliding plate 235 can slide along the sliding grooves 243, and the switching of the pressing sliding plate 235 between the first position and the second position is realized. Through the dual limitation on the sliding track of the pressing sliding plate 235 by the positioning sliding grooves 243 and the guide convex strips 245, the production error influence is reduced, the shaking of the pressing sliding plate 235 in the sliding process is avoided, and the good use experience of the user is improved.

A spring fixing groove 251 corresponding to the bead fixing tube 237 is formed in the clamping fixing groove 223. One end of the reset spring 232 is sheathed outside the bead fixing tube 23, and the other end of the reset spring is matched with the spring fixing groove 251, so that the reset spring 232 is disposed between the rotating plate 231 and the female buckle clamping portion 222. Under the effect of elasticity of the reset spring 232, the clamp hook 233 is positioned in the clamping groove 213, and the male buckle 21 and the female buckle 22 are tightly locked. After one end of the reset spring 232 of the rotating plate 231 is pressed, the rotating plate 231 rotates, the clamp hook 233 unclamped from the clamping groove 213, and the male buckle 21 is separated from the female buckle 22. The appearance of the male buckle 21 and the female buckle 22 of such a structure is attractive, and the operation is convenient. A sliding groove 224 matched with the male buckle clamping portion 212 is formed in the female buckle clamping portion 222, and a limiting surface 224*a* matched with the male buckle clamping portion 212 is disposed around the sliding groove 224. The buckling action of the sliding groove 224 on the female buckle clamping portion 222 has a guide effect. Through the limiting surface 224*a* and the clamping device 23, relative displacement cannot occur when the male buckle 21 and the female buckle 22 are buckled, and the clamping of the connecting buckle 2 is firm. At the same time, a width of the whole male buckle 21 is narrow, so that the first connecting portion 11 connected with the male buckle 21 may smoothly pass through trouser loops, and a user may conveniently use and change the belt.

Specifically, the end portion of the belt body 1 is sutured and fixed to the tail clip 3. The belt fixing groove 31 and the belt sliding through groove 32 on the tail clip 3 are in parallel arrangement. An avoiding space is formed in a suture position on the belt fixing groove 31, so that the second connecting portion 12 can be conveniently fixed to the tail clip 3 by a suture machine after the second connecting portion 12 of the belt body 1 passes through the belt sliding through groove 32 and bypasses the inner connecting rod 221*b*. The tail clip 3 formed through injection molding has high intensity, and can be matched with the connecting buckle 2 through surface treatment, so that the appearance of the whole belt is attractive.

Specifically, in Embodiment 1 as shown in FIG. 1 to FIG. 8, an inner side of the tail clip 3 is in an arch shape. That is, the side of the belt sliding through groove 32 far away from the belt fixing groove 31 is in an arch shape. Through the arch-shaped tail clip 3, the contact area during sliding is reduced, so that the sliding of the tail clip 3 is smoother, and a user can conveniently adjust the length of the belt.

Specifically, anti-slip teeth 321 are disposed at one side of the belt sliding through groove 32. An inclined guide surface 321*a* is disposed at one side of the anti-slip teeth 321, and the second connecting portion 12 can conveniently pass through the belt sliding through groove 32. After wearing the belt, the length of the belt is adjusted more proper, the second connecting portion 12 is tightly leaned on the anti-slip teeth 321, the belt body 1 is prevented from accidentally getting loose, and a good locking effect is achieved.

Specifically, a suture groove 311 is formed in an outer side of the belt fixing groove 31 on the tail clip 3, so that the tail clip 3 can be conveniently sutured and fixed to the end portion of the belt body 1 on the promise of sufficient intensity of the whole tail clip 3. The suture groove 311 is also configured to accommodate a suture line, so that the appearance of the whole tail clip is flat. In Embodiment 2 as shown in FIG. 9 to FIG. 11, through the suture groove 311 accommodating the suture line, the contact of the suture line with the human body is avoided, and the tail clip 3 can conveniently slide to adjust the length of the belt.

Specifically, one end of the male buckle 21 is provided with a connecting groove 214, the first connecting component 211 includes a tail tooth plate 211*a* rotationally disposed in the connecting groove 214, and a plurality of teeth 211*b* are disposed on the tail tooth plate 211*a*. By rotating the tail tooth plate 211*a*, the teeth 211*b* extrude the first connecting portion 11 of the belt body 1 into the connecting groove 214. The operation is convenient, and the connection is firm. Each of the teeth 211*b* is in an inclined conical shape. The teeth 211*b* need to tightly press the first connecting portion 11 into the connecting groove 214 to prevent the loose connection between the male buckle 21 and the belt body 1. The male buckle 21 has a small size, and is difficult to operate by pulling the tail tooth plate 211*a*, and the tail tooth plate 211*a* needs to be prized by great force with a tool. Through the structure of the inclined conical teeth 211*b*, when the first connecting portion 11 of the belt body 1 is taken out from the connecting groove 214, the first connecting portion 11 only needs to be pushed towards an inner side of the connecting groove 214, and the first connecting portion 11 provides inclination force for the teeth 211*b*, so that the tail tooth plate 211*a* becomes loose and rotates, the male buckle 21 is conveniently separated from the belt body 1, and a user may conveniently change a corresponding accessory.

Based on the above, the belt with a tail clip of the present disclosure includes a belt body provided with a connecting buckle and the tail clip. The connecting buckle includes a male buckle, a female buckle and a clamping device, one end of the male buckle is provided with a first connecting component, the other end of the male buckle is provided with a male buckle clamping portion, one end of the female buckle is provided with a second connecting component, the other end of the female buckle is provided with a female buckle clamping portion, the second connecting component includes an outer connecting rod and an inner connecting rod, and the male buckle clamping portion and the female buckle clamping portion are clamped and connected through the clamping device. A belt fixing groove and a belt sliding through groove are formed in the tail clip. One end of the belt body is fixed to the first connecting component of the male buckle, and an end portion of the other end of the belt body is fixed into the belt fixing groove after the other end of the belt body passes through the belt sliding through groove and bypasses the inner connecting rod. The belt with a tail clip has advantages that a length of the belt is convenient to adjust, the adjusting range is wide, the appearance is fashionable and the locking effect is good.

It shall be understood that modifications or variations may be made by those of ordinary skill in the art according to the above descriptions, and all of these modifications and variations shall fall within the protection scope of the appended claims of the present disclosure.

What is claimed is:

1. A belt with a tail clip, comprising: a belt body, wherein a connecting buckle and the tail clip are disposed on the belt body;

two ends of the belt body are respectively a first connecting portion and a second connecting portion;

the connecting buckle comprises a male buckle, a female buckle and a clamping device, one end of the male buckle is provided with a first connecting component, the other end of the male buckle is provided with a male buckle clamping portion, one end of the female buckle is provided with a second connecting component, the other end of the female buckle is provided with a female buckle clamping portion, the second connecting component comprises an outer connecting rod and an inner connecting rod, and the male buckle clamping portion and the female buckle connecting portion are clamped and connected through the clamping device;

a belt fixing groove and a belt sliding through groove are formed in the tail clip; and the first connecting portion of the belt body is fixed to the first connecting component of the male buckle, and an end portion of the second connecting portion of the belt body is fixed into the belt fixing groove after the second connecting portion of the belt body passes through the belt sliding through groove and bypasses the inner connecting rod.

2. The belt with a tail clip according to claim 1, wherein the male buckle clamping portion is provided with a clamping groove, the female buckle clamping portion is provided with a clamping fixing groove, the clamping device comprises a rotating plate clamped in the clamping fixing groove and a safety device disposed on the rotating plate, a rotating shaft is disposed in a middle of the rotating plate, the rotating plate is rotationally connected with the female buckle clamping portion through the rotating shaft, one end of the rotating plate is provided with a reset spring, and the other end of the rotating plate is provided with a clamp hook corresponding to the clamping groove.

3. The belt with a tail clip according to claim 2, wherein a sliding groove matched with the male buckle clamping portion is formed in the female buckle clamping portion, and a limiting surface matched with the male buckle clamping portion is disposed on the sliding groove.

4. The belt with a tail clip according to claim 2, wherein the safety device comprises a pressing sliding plate glidingly disposed at an outer side of the rotating plate, the pressing sliding plate is disposed at one end of the rotating plate near the reset spring, and a positioning device is disposed between the rotating plate and the pressing sliding plate.

5. The belt with a tail clip according to claim 1, wherein a bead fixing tube is disposed on a rotating plate in a protruded manner, a positioning device comprises an elastic bead disposed in the bead fixing tube, and a first positioning groove and a second positioning groove matched with the elastic bead are respectively formed in an inner side of a pressing sliding plate; and a spring fixing groove corresponding to the bead fixing tube is formed in a clamping fixing groove, one end of a reset spring is sheathed outside the bead fixing tube, and the other end of the reset spring is matched with the spring fixing groove.

6. The belt with a tail clip according to claim 1, wherein two corresponding positioning sliding grooves are formed on a rotating plate, L-shaped slide blocks corresponding to the positioning sliding grooves are disposed on a pressing sliding plate, and corresponding guide convex strips are respectively disposed at two sides of the pressing sliding plate on the rotating plate.

7. The belt with a tail clip according to claim 1, wherein an inner side of the tail clip is in an arch shape.

8. The belt with a tail clip according to claim 7, wherein anti-slip teeth are disposed at one side of the belt sliding through groove.

9. The belt with a tail clip according to claim 7, wherein a suture groove is formed in an outer side of the belt fixing groove on the tail clip.

10. The belt with a tail clip according to claim 1, wherein one end of the male buckle is provided with a connecting groove, the first connecting component comprises a tail tooth plate rotationally disposed in the connecting groove, a plurality of teeth are disposed on the tail tooth plate, and each of the teeth is in an inclined conical shape.

* * * * *